US011703299B1

(12) United States Patent
Chang

(10) Patent No.: US 11,703,299 B1
(45) Date of Patent: Jul. 18, 2023

(54) ARROW-RETAINING DEVICE OF A CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/746,095

(22) Filed: May 17, 2022

(51) Int. Cl.
*F41B 5/12* (2006.01)
*F41G 11/00* (2006.01)

(52) U.S. Cl.
CPC ..... *F41B 5/12* (2013.01); *F41G 11/003* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 7,017,560 | B2 * | 3/2006 | Eriksson | F02M 26/70 251/129.11 |
| 9,255,755 | B1 | 2/2016 | Barnett | |
| 9,255,757 | B2 * | 2/2016 | McPherson | F41B 5/12 |
| 9,395,143 | B2 | 7/2016 | Barnett | |
| 10,082,359 | B2 * | 9/2018 | Yehle | F41B 5/10 |
| 10,209,027 | B2 | 2/2019 | Chu et al. | |
| 10,677,558 | B2 * | 6/2020 | McPherson | F41B 5/12 |

FOREIGN PATENT DOCUMENTS

| | | |
|---|---|---|
| TW | I592625 B | 7/2017 |
| TW | I596315 B | 8/2017 |
| TW | M549334 U | 9/2017 |
| TW | I582373 A | 10/2017 |

* cited by examiner

*Primary Examiner* — John A Ricci
(74) *Attorney, Agent, or Firm* — Karin L. Williams; Alan D. Kamrath; Mayer & Williams PC

(57) ABSTRACT

A crossbow includes a rail and an arrow retention device including a bridge, a supporting element, a rolling unit, and two springs. The bridge includes a first section connected to the rail and a second section extending over the rail. The supporting element is connected to the second section of the bridge. The supporting element includes a pocket intersecting a bore. The rolling unit includes a roller and an axle. The axle includes a middle section for supporting the roller and two lateral sections extending from the roller. The lateral sections of the axle are located in two portions of the bore divided by the pocket. The roller includes a portion located in the pocket and another portion extending from the pocket to contact an arrow. The roller includes a smooth periphery. Each of the springs is compressed between the bridge and one of the lateral sections of the axle.

1 Claim, 6 Drawing Sheets

ARROW-RETAINING DEVICE OF A CROSSBOW

BACKGROUND OF INVENTION

1. Field of Invention

The present invention relates to a crossbow and, more particularly, to an arrow-retaining device of a crossbow.

2. Related Prior Art

As disclosed in Taiwanese Patent No. I582373, a conventional crossbow includes a rail, a limb (or limbs), a trigger, and an arrow retention spring. The limb is transversely connected to a front section of the rail. A trigger is connected to a rear section of the rail. The arrow retention spring is a leaf spring connected to the rail. The arrow retention spring presses and hence retains g an arrow. A user relies on his or her own discretion to adjust the extent to which the retention spring presses the arrow, and this is not precise. Moreover, the friction between the arrow retention spring and the arrow inevitably hinders shooting of the arrow.

As disclosed in Taiwanese Patent No. I592625, another conventional crossbow includes a sleeve (2), a rod (3), and a spring (4). An upper end of the sleeve (2) is connected to a lower portion of a sight bridge (15). The spring (4) abuts against the rod (3) so that a lower end of the rod (3) extends from the guiding sleeve (2) to abut against an arrow. The spring (4) exerts a constant force on the rod (3). However, the friction between the lower end of the rod (3) and the arrow inevitably hinders shooting of the arrow.

As disclosed in Taiwanese Patent No. M549334, another conventional crossbow includes a rail, an arrow retention element (51), a ball (52), and a spring (53). The arrow retention element (51) includes an abutment portion (515) below an aperture (514). The arrow retention element (51) is connected to a lower face of a connection portion (40) of a rail. The ball (52) and the spring (53) are located in the aperture (514). The ball (52) is confined by the abutment portion (515). The spring (53) presses a portion of the ball (52) so that an opposite portion of the ball (52) extends from the aperture (514) to abut against an arrow. The ball (52) is expected to reduce friction against the arrow. However, there is friction between the ball (52) and the abutment portion (515) because the ball (52) is confined by the abutment portion (515) when the arrow is not loaded on the rail. When the arrow is loaded on the rail, the ball (52) is pushed away from the abutment portion (515) by the arrow, but the spring (53) can easily jam the ball (52) so that the ball (52) fails to roll smoothly to reduce the friction against the arrow.

As disclosed in Taiwanese Patent No. I596315, another conventional crossbow includes a holder wheel (110) abut abutment against an arrow. The holder wheel (110) is expected to roll to reduce friction against shooting of an arrow. However, the holder wheel (110) includes a groove between two walls while the arrow is not perfectly straight. Hence, the walls of the holder wheel (110) inevitably exert lateral forces on the arrow. Such lateral forces inevitably jeopardize precision of the shooting of the arrow.

Therefore, the present invention is intended to obviate or at least alleviate the problems encountered in the prior art.

SUMMARY OF INVENTION

It is the primary objective of the present invention to provide a crossbow with an arrow retention device that can effectively retain an arrow without hindering shooting of the arrow.

To achieve the foregoing objective, the arrow retention device includes a bridge, a supporting element, a rolling unit, and two springs. The bridge includes a first section connected to a rail of the crossbow and a second section extending over the rail. The supporting element is connected to a lower face of the second section of the bridge. The supporting element includes a pocket intersecting a bore. The rolling unit includes a roller and an axle. The axle includes a middle section for supporting the roller and two opposite lateral sections extending from the roller. The lateral sections of the axle are respectively located in two portions of the bore divided by the pocket. The roller is located in the pocket, with a portion extending from the pocket. The roller includes a smooth periphery. Each of the springs is compressed between the bridge and one of the lateral sections of the axle.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
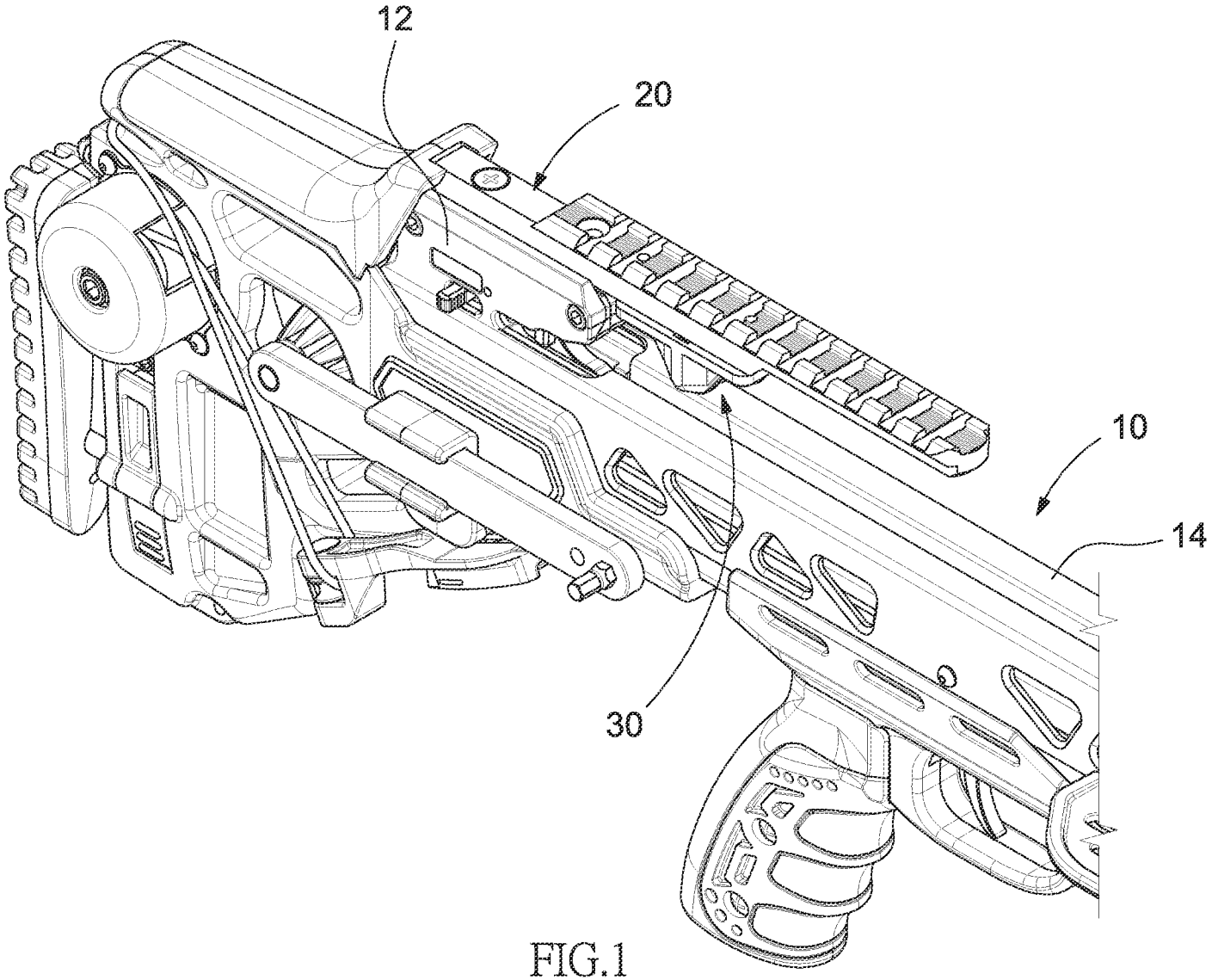
FIG. 1 is a perspective view of a crossbow according to the preferred embodiment of the present invention.
Figure 2:
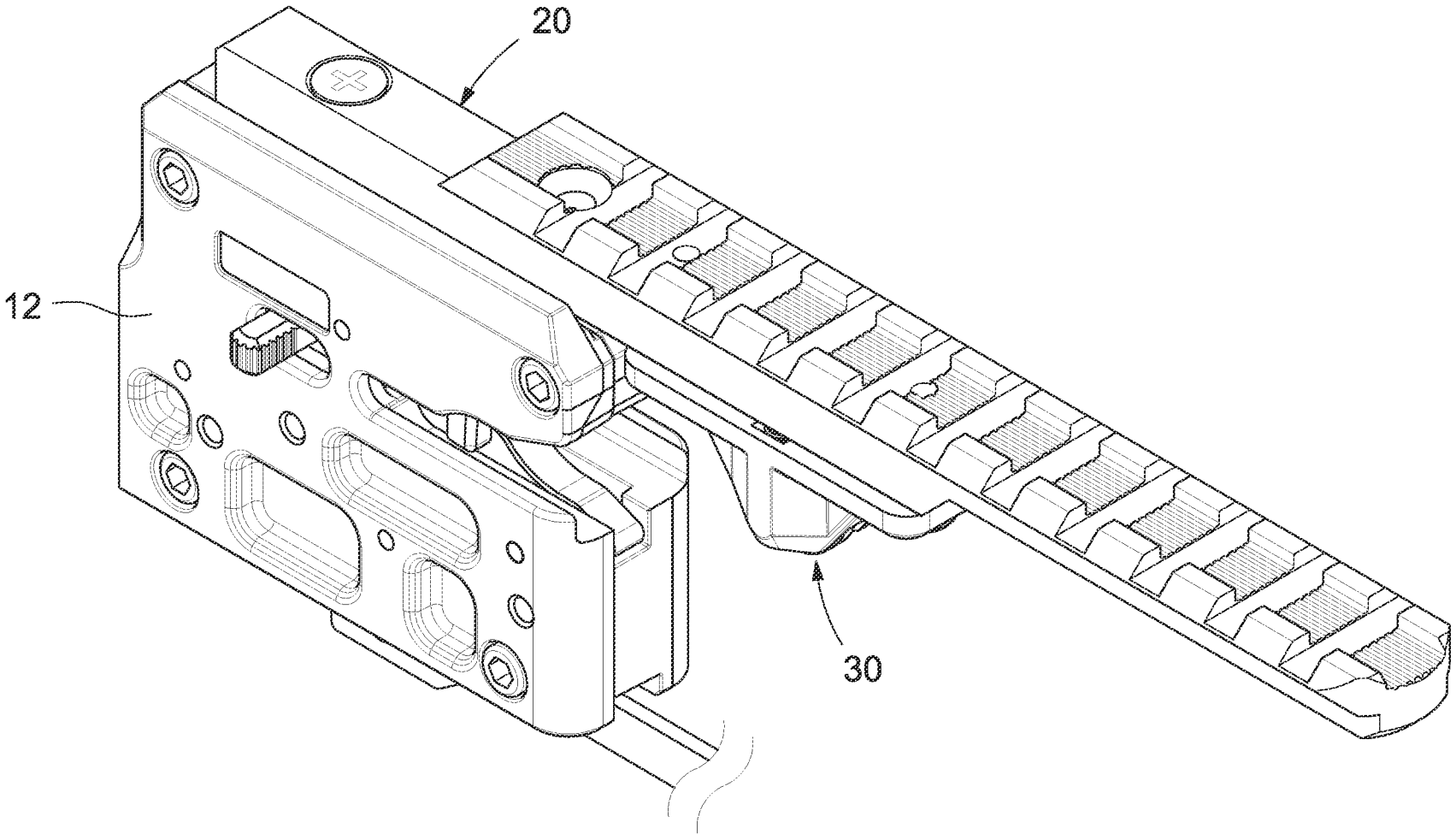
FIG. 2 is a partial view of the crossbow shown in FIG. 1.
Figure 3:
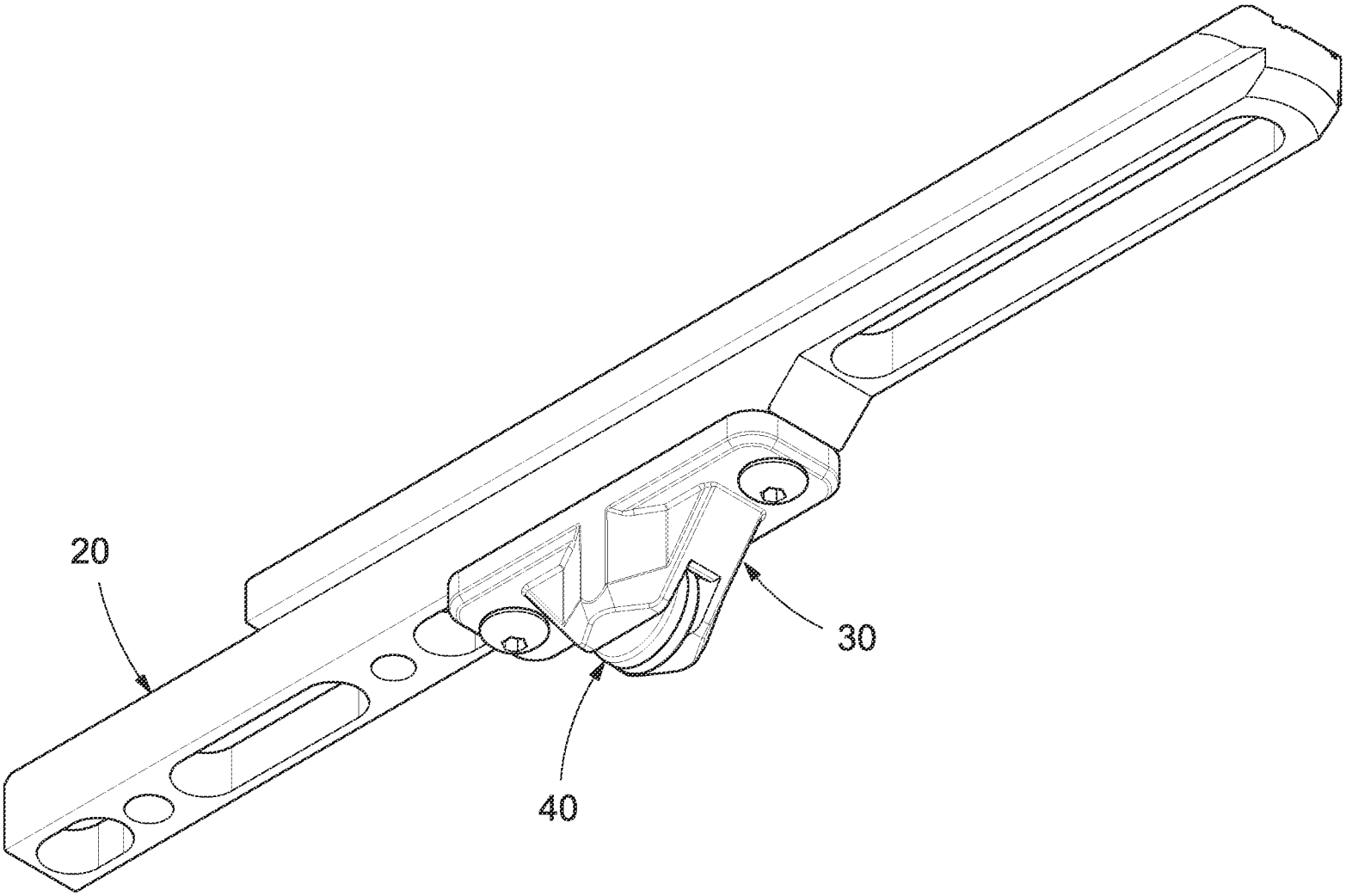
FIG. 3 is another partial view of the crossbow shown in FIG. 1.
Figure 4:
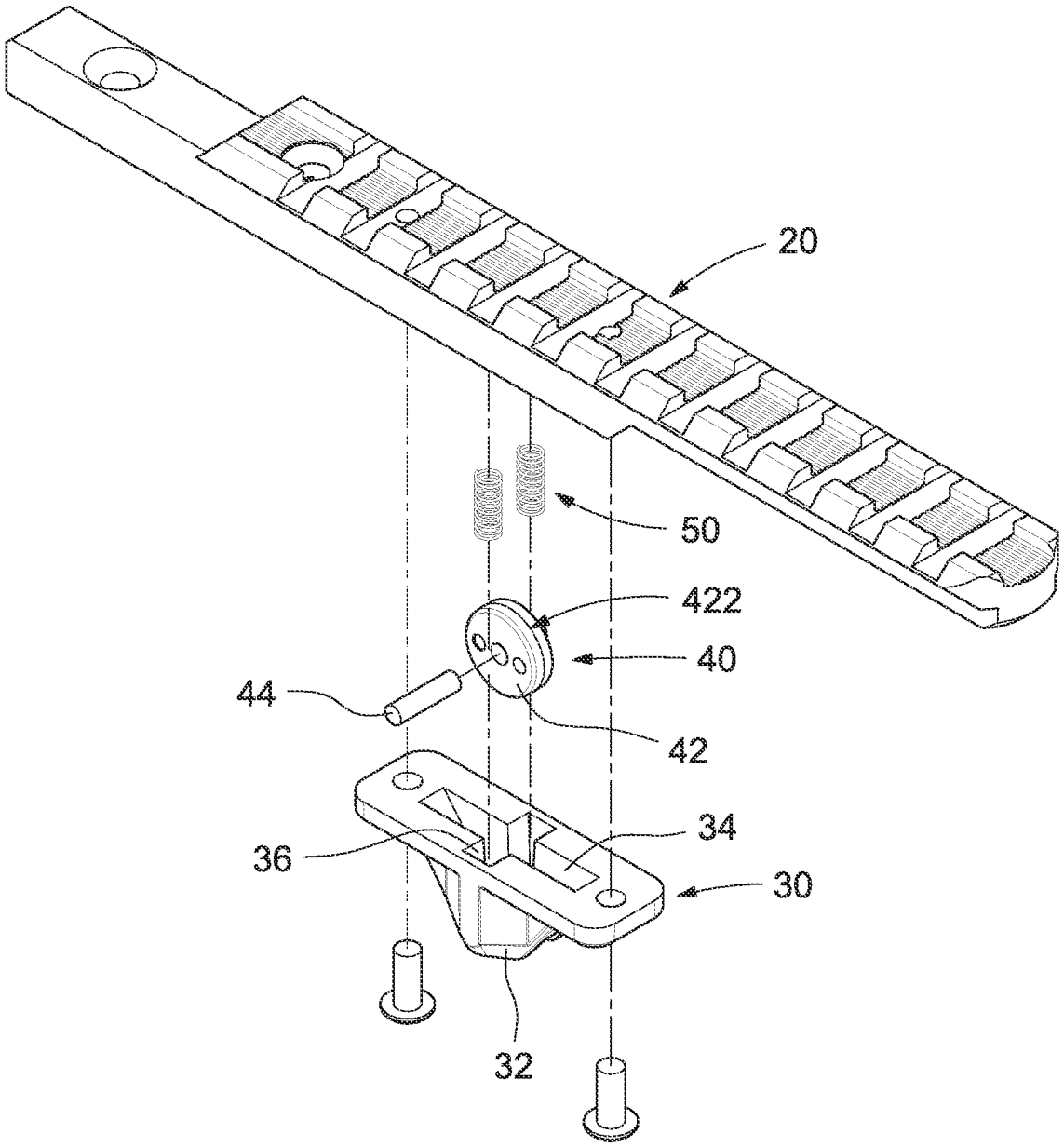
FIG. 4 is an exploded view of the crossbow shown in FIG. 3.
Figure 5:
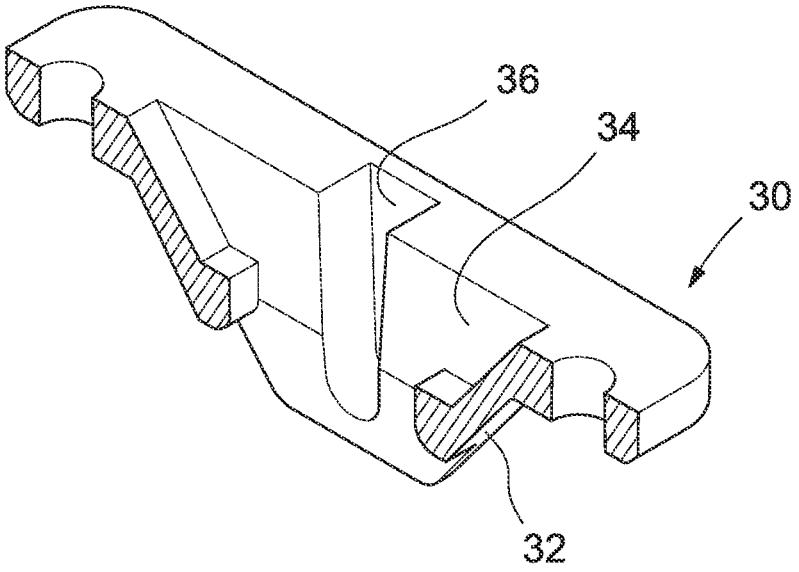
FIG. 5 is a cut-away view of the crossbow shown in FIG. 4.
Figure 6:
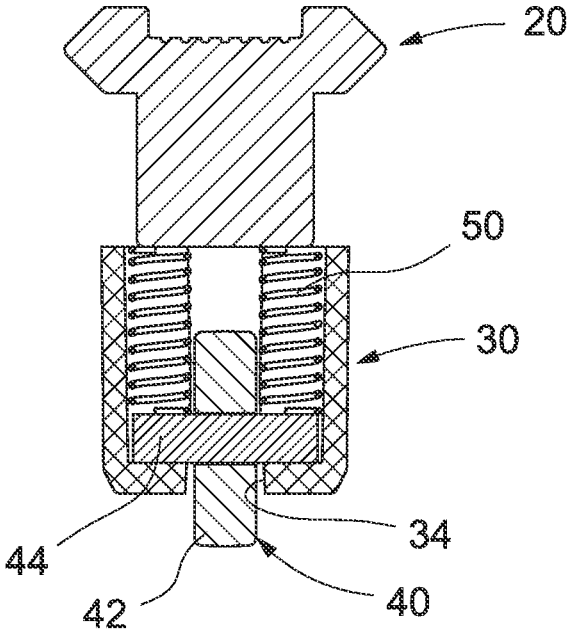
FIG. 6 is a cross-sectional view of the crossbow shown in FIG. 4.

Referring to FIGS. 1 to 6, a crossbow 10 includes a rail 14 and an arrow retention device according to the preferred embodiment of the present invention. The arrow retention device includes a bridge 20, a supporting element 30, a rolling unit 40 and multiple springs 50

A rear section of the bridge 20 is connected to a trigger 12 that is connected to the rail 14. A front section of the bridge 20 extends over the rail 14.

The supporting element 30 is connected to a lower face of the bridge 20 that is directed to an upper face of the rail 14. The supporting element 30 includes a shell 32, a pocket 34 and a bore 36. The pocket 34 and the bore 36 are made in the shell 32. The pocket 34 extends for a proper distance in a longitudinal direction of the shell 32. The bore 36 extends for another proper distance in a transverse direction of the shell 32. The pocket 34 and the bore 36 intersect each other.

The rolling unit 40 includes a roller 42 and an axle 44. The roller 42 includes a smooth periphery 422. The roller 42 is supported on the axle 44, i.e., the roller 42 receives a middle section of the axle 44.

The roller 42 is substantially located in the pocket 34, with a portion of the roller 42 extending from the pocket 34. The axle 44 is located in the bore 36.

The springs 50 are located m two portions of the bore 36 divided by the pocket 34. The springs 50 are respectively abutted against two lateral sections of the axle 44 on two opposite sides of the roller 42.

Figure 7:
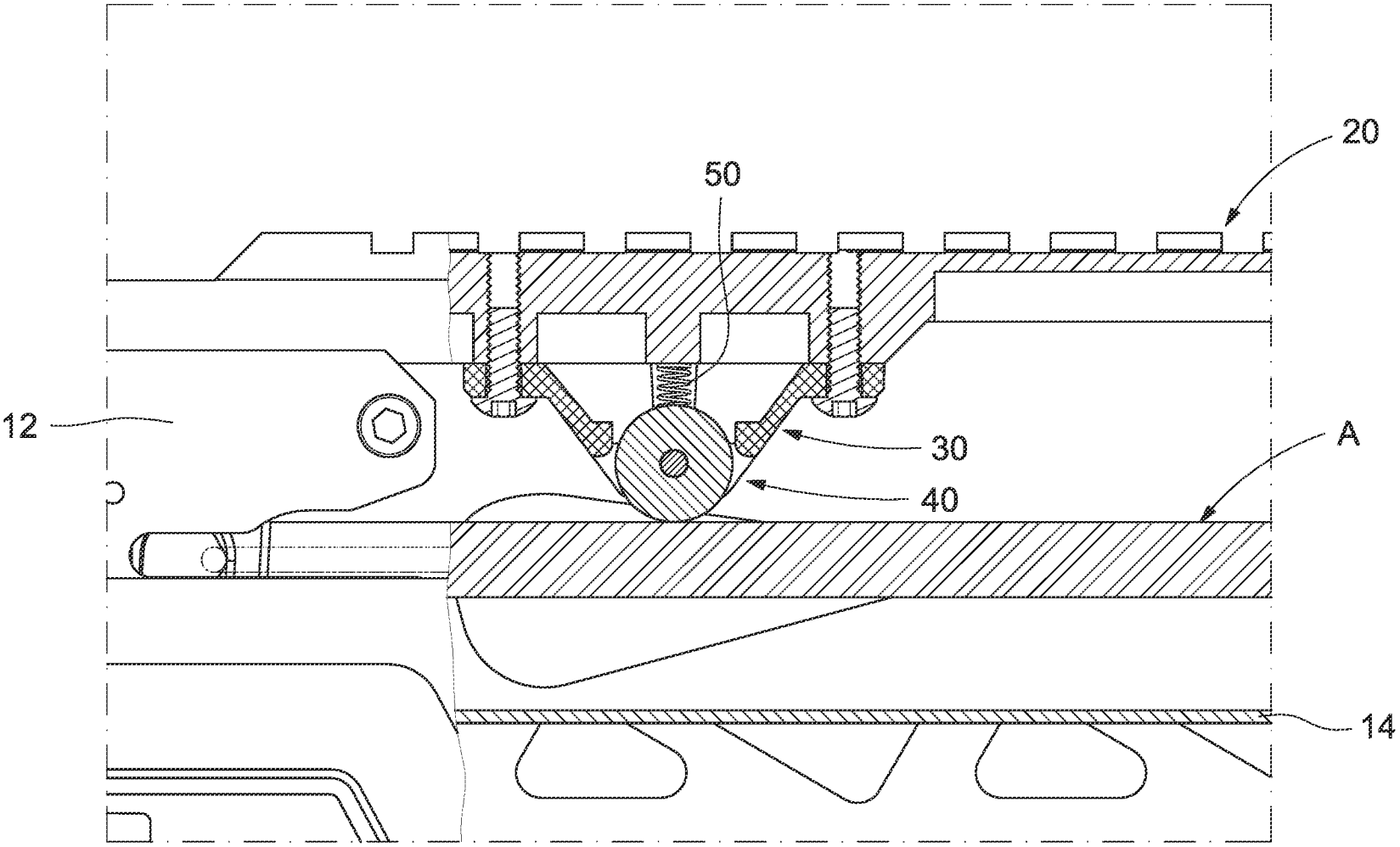
FIG. 7 is a cross-sectional view of the crossbow shown in FIG. 1.

Referring to FIG. 1 to 7, an arrow A is loaded on the rail 14 of the crossbow 10. The arrow A pushes the roller 42 of the rolling unit 40 upwards. As the rolling unit 40 is lifted, the lateral sections of the axle 44 compress the springs 50. That is, the springs 50 exert constant forces on the roller 42 so that the roller 42 exerts a constant force on the arrow A. The force exerted and related friction against the arrow A by the roller 42 retain the arrow A in position unless the trigger 12 is operated to shoot the arrow A from the rail 14.

When the arrow A moves on and along the rail 14, the rolling unit 40 rolls on the arrow A. Therefore, the friction between the rolling unit 40 and the arrow A is minimized. The periphery 422 of the roller 42 of the rolling unit 40 is smooth. Hence, the roller 42 does not exert any undesirable lateral faces on arrow A. Hence, the roller 42 does not jeopardize precision of the shooting of the arrow A.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow comprising a rail and an arrow retention device comprising:

a bridge comprising a first section connected to the rail and a second section extending over the rail;

a supporting element connected to a lower face of the second section of the bridge, wherein the supporting element comprises a pocket and a bore intersecting the pocket;

a rolling unit comprising a roller and an axle comprising a middle section for supporting the roller and two lateral sections extending from the roller, wherein the lateral sections of the axle are respectively located in two portions of the bore divided by the pocket, wherein the roller comprises a first portion located in the pocket and a second portion extending from the pocket to contact with an arrow, wherein the roller is formed with a smooth periphery; and two springs each of which is respectively compressed between one of the lateral sections of the axle and the bridge.

* * * * *